US011097538B2

(12) United States Patent
Hirai et al.

(10) Patent No.: US 11,097,538 B2
(45) Date of Patent: Aug. 24, 2021

(54) LIQUID EJECTION HEAD

(71) Applicant: Brother Kogyo Kabushiki Kaisha, Nagoya (JP)

(72) Inventors: Keita Hirai, Nagoya (JP); Shohei Koide, Nagoya (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/805,235

(22) Filed: Feb. 28, 2020

(65) Prior Publication Data

US 2020/0307192 A1 Oct. 1, 2020

(30) Foreign Application Priority Data

Apr. 1, 2019 (JP) ..... JP2019-069605

(51) Int. Cl.
*B41J 2/14* (2006.01)
*B41J 2/175* (2006.01)

(52) U.S. Cl.
CPC ..... *B41J 2/14* (2013.01); *B41J 2/175* (2013.01); *B41J 2002/14419* (2013.01)

(58) Field of Classification Search
CPC .... B41J 2/14; B41J 2/175; B41J 2002/14419; B41J 2/17509; B41J 2/14233; B41J 2202/12
USPC ..... 347/20
See application file for complete search history.

(56) References Cited

U.S. PATENT DOCUMENTS

2013/0233939 A1* 9/2013 Uezawa ..... B05B 17/0615 239/102.1
2019/0283418 A1* 9/2019 Kato ..... B41J 2/045

FOREIGN PATENT DOCUMENTS

JP 2008-290292 A 12/2008
JP 2015-036238 A 2/2015

* cited by examiner

*Primary Examiner* — Huan H Tran
*Assistant Examiner* — Alexander D Shenderov
(74) *Attorney, Agent, or Firm* — Banner & Witcoff, Ltd.

(57) ABSTRACT

A liquid ejection head includes a supply manifold, a plurality of supply throttle channels, a plurality of pressure chambers, and a plurality of nozzles. The supply manifold includes a supply opening through which liquid is supplied from an exterior. The supply manifold extends in a first direction. Each of the supply throttle channels is connected, at one end thereof, to the supply manifold, and extends in a second direction. Each of the pressure chambers is connected to the other end of a corresponding one of the supply throttle channels, and extends in a third direction different from the first direction. Each of the nozzles communicates with a corresponding one of the pressure chambers. The second direction in which each of the supply throttle channels extends has a component of the first direction and a component of the third direction.

15 Claims, 9 Drawing Sheets

LIQUID EJECTION HEAD

CROSS-REFERENCE TO RELATED APPLICATION

This application claims priority from Japanese Patent Application No. 2019-069605 filed on Apr. 1, 2019, the content of which is incorporated herein by reference in its entirety.

TECHNICAL FIELD

Aspects of the disclosure relate to a liquid ejection head.

BACKGROUND

A known liquid ejection head includes a nozzle, a pressure chamber communicating with the nozzle, a liquid supply channel through which liquid is supplied to the pressure chamber, and a liquid discharge channel through which liquid is discharged from the pressure chamber. Ink is supplied through the liquid supply channel to fill the pressure chamber. A part of ink in the pressure chamber is ejected, as ink droplets, from the nozzle, and the remaining ink is circulated through the liquid discharge channel.

SUMMARY

In the known liquid ejection head, a liquid flow direction in the pressure chamber is opposite to a liquid flow direction in the liquid supply channel. This may cause a considerable pressure loss when liquid flows from the liquid supply channel into the pressure chamber, resulting in a decrease in liquid circulation rate. To cope with this, it is conceivable to increase a pump pressure to increase the flow rate in the liquid supply channel. However, this may fluctuate the pressure balance near the nozzle, causing a breakage of a meniscus of the nozzle.

Aspects of the disclosure provide a liquid ejection head configured to reduce pressure loss in liquid.

According to one or more aspects of the disclosure, a liquid ejection head includes a supply manifold, a plurality of supply throttle channels, a plurality of pressure chambers, and a plurality of nozzles. The supply manifold includes a supply opening through which liquid is supplied from an exterior. The supply manifold extends in a first direction. Each of the supply throttle channels is connected, at one end thereof, to the supply manifold, and extends in a second direction. Each of the pressure chambers is connected to the other end of a corresponding one of the supply throttle channels, and extends in a third direction different from the first direction. Each of the nozzles communicates with a corresponding one of the pressure chambers. The second direction in which each of the supply throttle channels extends has a component of the first direction and a component of the third direction.

According to one or more other aspects of the disclosure, a liquid ejection head includes a nozzle, a pressure chamber, a supply throttle channel, and a supply manifold. The pressure chamber is connected to the nozzle. The supply throttle channel has a first end connected to the pressure chamber, and a second end opposite to the first end. The supply manifold includes a supply opening through which liquid is supplied from an exterior. The supply manifold is connected to the second end of the supply throttle channel. The supply throttle channel extends such that, in an extending direction of the supply manifold, the second end is closer to the supply opening than the first end. The pressure chamber extends such that, in an extending direction of the supply throttle channel, a portion thereof connected to the nozzle is opposite to the second end of the supply throttle channel relative to a portion thereof connected to the first end of the supply throttle channel.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Illustrative embodiments of the disclosure will be described with reference to the drawings.

First Illustrative Embodiment

<Structure of Liquid Ejection Apparatus>

A liquid ejection apparatus 10 including a liquid ejection head 20 (hereinafter referred to as a "head") according to a first illustrative embodiment is configured to eject liquid. Hereinafter, the liquid ejection apparatus 10 will be described by way of example, as applied to, but not limited to, an inkjet printer.

Figure 1:
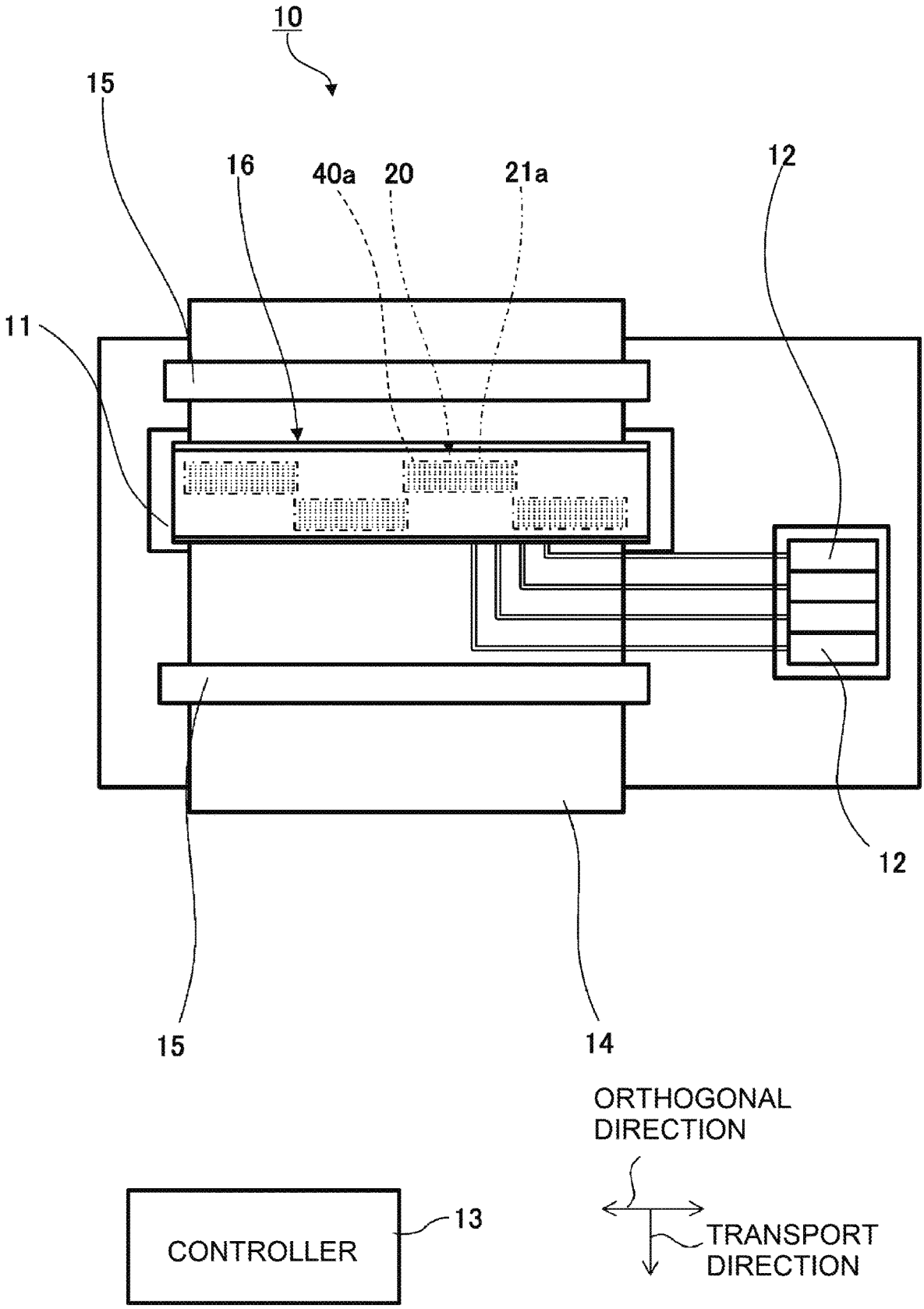
FIG. 1 is a schematic diagram of a liquid ejection apparatus including a liquid ejection head according to a first illustrative embodiment.

As shown in FIG. 1, the liquid ejection apparatus 10 employs a line head type and includes a platen 11, a transport unit, a head unit 16, tanks 12, and a controller 13. The liquid ejection apparatus 10 may employ a serial head type or other types than the line head type.

The platen 11 is a flat plate member to receive thereon a sheet 14 and adjust a distance between the sheet 14 and the head unit 16. Herein, one side of the platen 11 toward the head unit 16 is referred to as an upper side, and the other side of the platen 11 away from the head unit 16 is referred to as a lower side. However, the liquid ejection apparatus 10 may be positioned in other orientations.

The transport unit may include two transport rollers 15 and a transport motor (not shown). The two transport rollers 15 are disposed parallel to each other while interposing the platen 11 therebetween in a transport direction, and are connected to the transport motor. When the transport motor is driven, the transport rollers 15 rotate to transport the sheet 14 on the platen 11 in the transport direction.

The head unit 16 has a length greater than or equal to the length of the sheet 14 in a direction (an orthogonal direction) orthogonal to the transport direction of the sheet 14. The head unit 16 includes a plurality of heads 20.

Each head 20 includes a stack structure including a channel unit and a volume changer. The channel unit includes liquid channels formed therein and a plurality of nozzle holes 21*a* open on a lower surface (an ejection surface 40*a*). The volume changer is driven to change the volume of a liquid channel. In this case, a meniscus in a nozzle hole 21*a* vibrates and liquid is ejected from the nozzle hole 21*a*. The head 20 will be described in detail later.

Separate tanks 12 are provided for different kinds of inks. For example, each of four tanks 12 stores therein a corresponding one of black, yellow, cyan, and magenta inks. Inks of the tanks 12 are supplied to corresponding nozzle holes 21*a*.

The controller 13 includes a processor such as a central processing unit (CPU), memories such as a random access memory (RAM) and a read only memory (ROM), and a driver integrated circuit (IC) such as an application specific integrated circuit (ASIC). In the controller 13, upon receipt of various requests and detection signals from sensors, the CPU causes the RAM to store various data and outputs various execution commands to the ASIC based on programs stored in the ROM. The ASIC controls the driver ICs based on the commands to execute required operation. The transport motor and the volume changer are thereby driven.

Specifically, the controller 13 executes ejection from the head unit 16, and transport of sheets 14. The head unit 16 is controlled to eject ink from the nozzle holes 21*a*. A sheet 14 is transported in the transport direction intermittently by a predetermined amount. Printing progresses by execution of ink ejection and sheet transport.

<Structure of Head>

Figure 2:
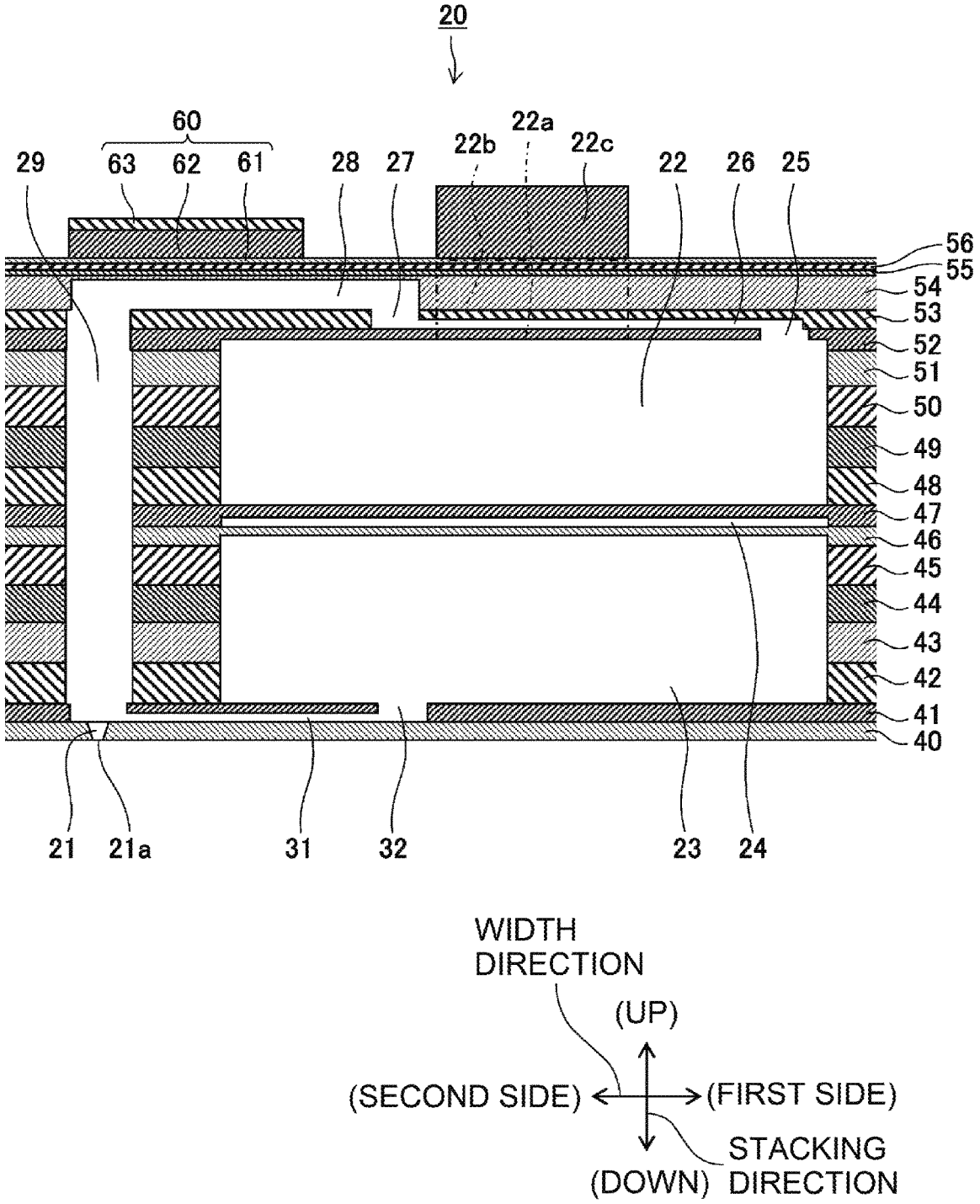
FIG. 2 is a cross-sectional view of the liquid ejection head of FIG. 1 taken along a line orthogonal to an array direction.
Figure 3:
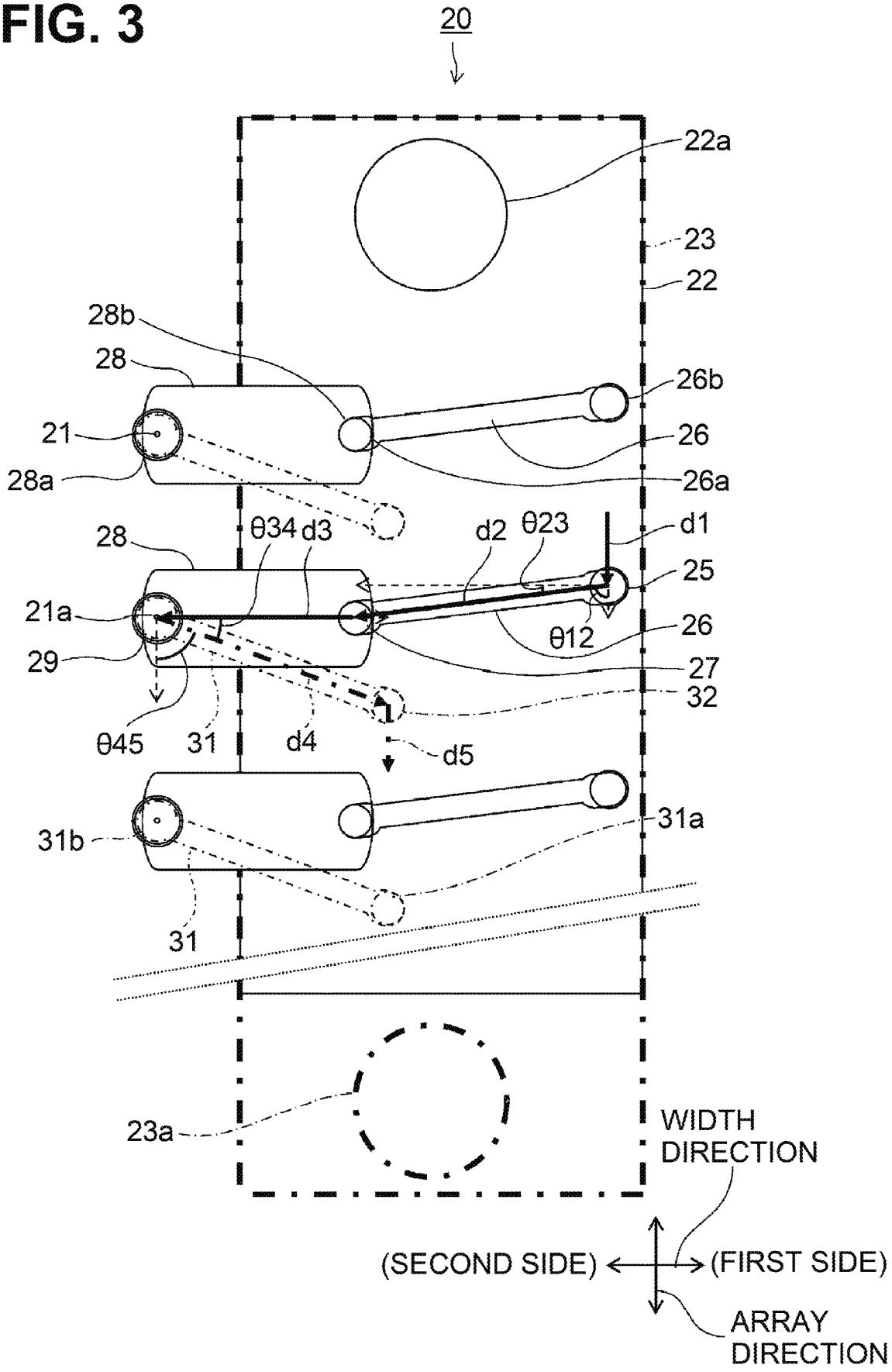
FIG. 3 is a top view of the liquid ejection head of FIG. 1 in a stacking direction, showing a positional relation of manifolds, throttle channels, communication holes, and pressure chambers.

As described above, each head 20 includes the channel unit and the volume changer. As shown in FIGS. 2 and 3, the channel unit is formed by a stack of a plurality of plates, and the volume changer includes a vibration plate 55 and piezoelectric elements 60.

The plurality of plates include a nozzle plate 40, a first channel plate 41, a second channel plate 42, a third channel plate 43, a fourth channel plate 44, a fifth channel plate 45, a sixth channel plate 46, a seventh channel plate 47, an eighth channel plate 48, a ninth channel plate 49, a 10th channel plate 50, an 11th channel plate 51, a 12th channel plate 52, a 13th channel 53, and a 14th channel plate 54. These plates are stacked in this order in a stacking direction.

Each plate has holes and grooves of various sizes. A combination of holes and grooves in the stacked plates of the channel unit define liquid channels such as a plurality of nozzles 21, a plurality of individual channels, a supply manifold 22, and a return manifold 23.

The nozzles 21 are formed to penetrate the nozzle plate 40 in the stacking direction. Ends of nozzles 21 (nozzle holes 21*a*) are arranged, as a nozzle array, in an array direction on the ejection surface 40*a* of the nozzle plate 40.

The array direction is orthogonal to the stacking direction and may be parallel or inclined relative to the orthogonal direction shown in FIG. 1. A first direction d1 through a fifth direction d5, which are directions of liquid channels, will now be described. Herein, the first direction d1 and the fifth direction d5 are described as being parallel to the array direction, and the third direction d3 is described as being parallel to a direction (a width direction) orthogonal to the array direction and the stacking direction. However, the first direction d1 and the fifth direction d5 may be inclined relative to the array direction. The third direction d3 may be inclined relative to the width direction.

The supply manifold 22 extends long in the first direction d1 and is connected to the individual channels. The return manifold 23 extends long in the fifth direction d5 and is connected to the individual channels. The fifth direction d5 may be parallel or inclined relative to the first direction d1.

The supply manifold 22 is stacked on the return manifold 23. The supply manifold 22 and the return manifold 23 overlap each other in a direction (the stacking direction) orthogonal to a plane including the third direction d3 and the first direction d1. This may downsize the liquid ejection head 20 in a direction orthogonal to the stacking direction.

The cross-sectional area defined by the supply manifold 22 to be orthogonal to the first direction d1 is equal to the cross-sectional area defined by the return manifold 23 to be orthogonal to the fifth direction d5. For example, the supply manifold 22 and the return manifold 23 may be the same in size and shape. In this case, the supply manifold 22 and the return manifold 23 may have the same dimensions in the array direction, in the width direction, and in the stacking direction. For example, each of the manifolds 22 and 23 has a cross-sectional area of 1000 $\mu m^2$ or more and 2000 $\mu m^2$ or less.

The supply manifold 22 is formed by through-holes penetrating in the stacking direction the eighth channel plate 48 through the 11th channel plate 51, and a recess recessed from a lower surface of the 12th channel plate 52. The recess overlaps the through-holes in the stacking direction. A lower end of the supply manifold 22 is covered by the seventh channel plate 47, and an upper end of the supply manifold 22 is covered by an upper portion of the 12th channel plate 52.

The return manifold 23 is formed by through-holes penetrating in the stacking direction the second channel plate 42 through the fifth channel plate 45, and a recess recessed from a lower surface of the sixth channel plate 46. The recess overlaps the through-holes in the stacking direction. A lower end of the return manifold 23 is covered by the first channel plate 41, and an upper end of the return manifold 23 is covered by an upper portion of the sixth channel plate 46.

The supply manifold 22 and the return manifold 23 define a buffer space 24 therebetween. The buffer space 24 is formed by a recess recessed from a lower surface of the seventh channel plate 47. In the stacking direction, the supply manifold 22 and the buffer space 24 are adjacent to each other via an upper portion of the seventh channel plate 47, and the return manifold 23 and the buffer space 24 are adjacent to each other via the upper portion of the sixth channel plate 46. The buffer space 24 sandwiched between the supply manifold 22 and the return manifold 23 may reduce interaction between the liquid pressure in the supply manifold 22 and the liquid pressure in the return manifold 23.

The supply manifold 22 includes a supply opening 22*a* at its one end in the array direction (an upstream end in the first direction d1). In this embodiment, a supply passage 22*b* is connected, at its lower end, to the supply opening 22*a* and extends upward from the supply opening 22*a*. For example, the supply passage 22*b* penetrates an upper portion of the 12th channel plate 52, the 13th channel plate 53, the 14th channel plate 54, the vibration plate 55, and an insulating film 56. An upper end of the supply passage 22*b* is connected to an inner space of a cylindrical supply port 22*c*.

The return manifold 23 includes a return opening 23*a* at its other end in the array direction (a downstream end in the fifth direction d5). In this embodiment, a return passage is connected, at its lower end, to the return opening 23*a* and extends upward from the return opening 23*a*. For example, the return passage penetrates the sixth through 14th channel plates 46-52, the vibration plate 55, and an insulating film 56. An upper end of the return passage is connected to an inner space of a cylindrical return port. For example, the return opening 23*a* at the other end of the return manifold 23 in the array direction is downstream of the downstream end of the supply manifold 22.

The plurality of individual channels are connected to the supply manifold 22 and to the return manifold 23. Each individual channel is connected, at its upstream end, to the supply manifold 22, connected, at its downstream end, to the return manifold 23, and connected, at its midstream, to a base end of a corresponding nozzle 21. Each individual channel includes a first communication hole 25, a supply throttle channel 26, a second communication hole 27, a pressure chamber 28, a descender 29, a return throttle channel 31, and a third communication hole 32, which are arranged in this order.

The first communication hole 25 is connected, at its lower end, to an upper end of the supply manifold 22, and extends upward from the supply manifold 22 in the stacking direction to penetrate an upper portion of the 12th channel plate 52 in the stacking direction. The first communication hole 25 is offset to one side (a first side) from a center of the supply manifold 22 in the width direction. The cross-sectional area defined by the first communication hole 25 to be orthogonal to the stacking direction is less than the cross-sectional area defined by the supply manifold 22 to be orthogonal to the first direction d1. For example, the first communication hole 25 has a cross-sectional area of 100 $\mu m^2$ or more and 200 $\mu m^2$ or less.

The supply throttle channel 26 is connected, at its one end (a first-side end in the width direction, e.g., a second end 26*b*), to an upper end of the first communication hole 25 and extends in the second direction d2. The supply throttle channel 26 is formed by a groove recessed from a lower surface of the 13th channel plate 53. The cross-sectional area defined by the supply throttle channel 26 to be orthogonal to the second direction d2 is less than the cross-sectional area defined by the first communication hole 25 to be orthogonal to the stacking direction. For example, the supply throttle channel 26 has a cross-sectional area of 50 $\mu m^2$ or more and 90 $\mu m^2$ or less. The supply throttle channel 26 will be described in detail later.

The second communication hole 27 is connected, at its lower end, to the other end (a second-side end in the width direction, e.g., a first end 26*a*) of the supply throttle channel 26, and extends from the supply throttle channel 26 upward in the stacking direction to penetrate an upper portion of the 13th channel plate 53. The second communication hole 27 is offset to the other side (a second side) from the center of the supply manifold 22 in the width direction. The cross-sectional area defined by the second communication hole 27 to be orthogonal to the stacking direction is greater than the cross-sectional area defined by the supply throttle channel 26 to be orthogonal to the second direction d2. For example, the second communication hole 27 has a cross-sectional area of 100 $\mu m^2$ or more and 200 $\mu m^2$ or less.

The pressure chamber 28 is connected, at its one end (a first-side end 28*b*), to an upper end of the second communication hole 27 and extends in the third direction d3. The pressure chamber 28 penetrates the 14th channel plate 54 in the stacking direction. The cross-sectional area defined by the pressure chamber 28 to be orthogonal to the third direction d3 is less than the cross-sectional area defined by the second communication hole 27 to be orthogonal to the stacking direction. For example, the pressure chamber has a cross-sectional area of 300 $\mu m^2$ or more and 400 $\mu m^2$ or less.

The descender 29 penetrates the first through 13th plate channels 41-53 in the stacking direction and is located further to the second side in the width direction than the supply manifold 22 and the return manifold 23. The descender 29 is connected, at its upper end, to the other end (a second-side end 28*a*) of the pressure chamber 28, and connected, at its lower end, to the nozzle 21. For example, the nozzle 21 is located to overlap the descender 29 in the stacking direction and is located at a center of the descender 29 in a direction orthogonal to the stacking direction.

The descender 29 may have a cross-sectional area which is uniform or varies in the stacking direction. For example, an upper portion (defined by the 12th plate channel 52 and the 13th plate channel 53) of the descender 29 may have a cross-sectional area which decreases toward the upper end.

The return throttle channel 31 is connected, at its one end (a second-side end, e.g., a fourth end 31*b*), to a lower end of the descender 29 and extends in the fourth direction d4. The return throttle channel 31 is formed by a groove recessed from a lower surface of the first channel plate 41. The cross-sectional area defined by the return throttle channel 31 to be orthogonal to the fourth direction d4 is less than the cross-sectional area defined by the descender 29 to be orthogonal to the stacking direction. For example, the return throttle channel 31 has a cross-sectional area of 50 $\mu m^2$ or more and 90 $\mu m^2$ or less.

The return throttle channel 31 will be described in detail later.

The third communication hole 32 is connected, at its lower end, to the other end (a first-side end, e.g., a third end 31*a*) of the return throttle channel 31, and extends from the return throttle channel 31 upward in the stacking direction to penetrate an upper portion of the first channel plate 41. The third communication hole 32 is connected to a lower end of the return manifold 23. The third communication hole 32 is offset to the second side from a center of the return manifold 23 in the width direction. The cross-sectional area defined by the third communication hole 32 to be orthogonal to the stacking direction is greater than the cross-sectional area defined by the return throttle channel 31 to be orthogonal to the fourth direction d4. For example, the third communication hole 32 has a cross-sectional area of 100 $\mu m^2$ or more and 200 $\mu m^2$ or less.

The vibration plate 55 is stacked on the 14th channel plate 54 to cover upper openings of the pressure chambers 28. The vibration plate 55 may be integral with the 14th channel plate 54. In this case, each pressure chamber 28 is recessed from a lower surface of the 14th channel plate 54. An upper portion of the 14th channel plate 54, which is above each pressure chamber 28, functions as the vibration plate 55.

Each piezoelectric element 60 includes a common electrode 61, a piezoelectric layer 62, and an individual electrode 63 which are arranged in this order. The common electrode 61 entirely covers the vibration plate 55 via the insulating film 56. Each piezoelectric layer 62 is located on the common electrode 61 to overlap a corresponding pressure chamber 28. Each individual electrode 63 is provided for a corresponding pressure chamber 28 and is located on a corresponding piezoelectric layer 62. In this case, a piezoelectric element 60 is formed by an active portion of a piezoelectric layer 62, which is sandwiched by an individual electrode 63 and the common electrode 61.

Each individual electrode 63 is electrically connected to the driver IC. The driver IC receives control signals from the controller 13 (FIG. 1) and generates drive signals (voltage signals) selectively to the individual electrodes 63. In contrast, the common electrode 61 is constantly maintained at a ground potential.

In response to a drive signal, an active portion of each selected piezoelectric layer 62 expands and contracts in a surface direction, together with the two electrodes 61 and 63. Accordingly, the vibration plate 55 corporates to deform to increase and decrease the volume of a corresponding pressure chamber 28. This applies a pressure to the corresponding pressure chamber 28 which in turn ejects liquid from a nozzle 21.

<Liquid Flow>

By way of example, the supply opening 22*a* is connected via a supply conduit to a subtank, and the return opening 23*a* is connected, via a return conduit, to the subtank. When a pressure pump in the supply conduit and a negative-pressure pump in the return conduit are driven, liquid from the subtank passes through the supply conduit to flow from an exterior, via the supply opening 22*a*, into the supply manifold 22 where liquid flows in the first direction d1.

Meanwhile, liquid partially flows into the individual channels. In each individual channel, liquid flows from the supply manifold 22, via the first communication hole 25, into the supply throttle channel 26 where liquid flows in the second direction d2. Liquid further flows from the supply throttle channel 26, via the second communication hole 27, into the pressure chamber 28 where liquid flows in the third direction d3. Then, liquid flows from an upper end to a lower end of the descender 29 in the stacking direction to enter the nozzle 21. When the piezoelectric element 60 applies an ejection pressure to the pressure chamber 28, liquid is ejected from a nozzle hole 21*a*.

Remaining liquid flows in the return throttle channel 31 in the fourth direction d4 and flows, via the third communication hole 32, into the return manifold 23. Then, liquid flows in the return manifold 23 in the fifth direction d5 to exit from the return opening 23*a* to the exterior, and returns through the return conduit to the subtank. Thus, liquid not ejected from the nozzles 21*a* circulates between the subtank and the individual channels.

<Structure of Supply Throttle Channel>

As shown in FIG. 3, in each individual channel, the supply throttle channel 26 extends in the second direction d2 which has a component of the first direction d1 and a component of the third direction d3. The first direction d1 is a direction in which the supply manifold 22 extends, and the third direction d3 is a direction in which the pressure chamber 28 extends. Thus, the second direction d2 is inclined relative to the first direction d1 and the third direction d3.

When liquid flows from the supply manifold 22 into the supply throttle channel 26, the liquid flow is redirected from the first direction d1 to the second direction d2. In this case, because the second direction d2 has, as a directional component, a component of the first direction d1, liquid in the supply throttle channel 26 flows in the second direction d2 by the use of the pressure of the liquid flow in the first direction d1. Because the second direction d2 does not have, as a directional component, a component of a direction opposite to the first direction d1, a resistance to liquid flow in the second direction d2 is reduced, resulting in a reduction in pressure loss.

When liquid flows from the supply throttle channel 26 into the pressure chamber 28, the liquid flow is redirected from the second direction d2 to the third direction d3. In this case, because the third direction d3 has, as a directional component, a component of the second direction d2, liquid in the pressure chamber 28 flows in the third direction d3 by the use of the pressure of the liquid flow in the second direction d2. In addition, because the third direction d3 does not have, as a directional component, a component of a direction opposite to the second direction d2, resistance to the liquid flow in the third direction d3 is reduced, resulting in a reduction in pressure loss.

In a case where the supply manifold 22 and the return manifold 23 are stacked on each other, it is not allowed to increase the cross-sectional area of each manifold. In such a case that is susceptible to pressure loss, a reduction in pressure loss is effective.

For example, an angle θ12 between the first direction d1 and the second direction d2, and an angle θ23 between the second direction d2 and the third direction d3 are greater than 0° and less than 90°. The sum of the angle θ12 and the angle θ23 is less than 180°. For example, the angle θ23 is less than the angle θ21. For example, the angle θ12 is 80° or more and 87° or less. For example, the angle θ23 is 3° or more and 10° or less.

When θ23<θ12 is satisfied, pressure loss may be reduced in the pressure chamber 28 having a high flow velocity. Specifically, the flow velocity in the supply throttle channel 26 is higher than that in the supply manifold 22 and that in the pressure chamber 28. The flow velocity in the pressure chamber 28 is higher than that in the supply manifold 22. A flow direction (the second direction d2) in the supply throttle channel 26 is set to be closer to a flow direction (the third direction d3) in the pressure chamber 28 than to a flow direction (the first direction d1) in the supply manifold 22. In the supply throttle channel 26 which communicates with the pressure chamber 28 having a high flow velocity, an angle difference θ23 at a flow-out end of the supply throttle channel 26 is less than an angle difference θ12 at a flow-in end of the supply throttle channel 26. This promotes liquid flow, thereby reducing pressure loss.

Further, the first communication hole 25 is located between the supply manifold 22 and the supply throttle channel 26. The first communication hole 25 is greater in size than the cross-sectional area defined by the supply throttle channel 26 to be orthogonal to the second direction d2 and is less in size than the cross-sectional area defined by the supply manifold 22 to be orthogonal to the first direction d1. Thus, the supply manifold 22, the first communication hole 25, and the supply throttle channel 26 gradually decrease in size in this order. This may prevent a sharp decrease in area and reduce pressure loss of the liquid flowing in this order.

Further, the second communication hole 27 is located between the pressure chamber 28 and the supply throttle channel 26. The second communication hole 27 is greater in size than the cross-sectional area defined by the supply throttle channel 26 to be orthogonal to the second direction d2 and is less in size than the cross-sectional area defined by the pressure chamber 28 to be orthogonal to the third direction d3. Thus, the supply throttle channel 26, the second communication hole 27, and the pressure chamber 28 gradually increase in size in this order. This may prevent a sharp increase in area and reduce pressure loss of the liquid flowing in this order.

The cross-sectional area of the supply throttle channel 26 is less than the cross-sectional area of the pressure chamber 28. For example, a resistance of the liquid flowing in the supply throttle channel 26 is set to 0.7 kPa·s/μl·cps or more. This may prevent a pressure applied by the piezoelectric element 60 to the pressure chamber 28 from being transmitted to the supply manifold 22.

The supply throttle channel 26 has the first end 26*a* connected to the pressure chamber 28, and the second end 26*b* opposite to the first end 26*a*. The supply manifold 22 includes the supply opening 22*a* through which liquid is supplied from an exterior, and extends to receive the second ends 26*a* of the supply throttle channels 26.

The supply throttle channel 26 extends such that the second end 26*b* is closer to the supply opening 22*a* than the first end 26*a* in an extending direction of the supply manifold 22. In an extending direction of the supply throttle channel 26, the pressure chamber 28 extends such that its portion (the second-side end 28*a*) connected to the nozzle 21 is opposite to the second end 26*b* relative to its portion (the first-side end 28*b*) connected to the first end 26*a*.

Thus, liquid from the supply manifold 22 flows from the second end 26*b* to the first end 26*a* of the supply throttle channel 26 and flows from the first-side end 28*b* to the second-side end 28*a* of the pressure chamber 28. In this case, a liquid flow direction (the second direction d2) in the supply throttle channel 26 has a component of a liquid flow direction (the first direction d1) in the supply manifold 22, and a component of a liquid flow direction (the third direction d3) in the pressure chamber 28. This may reduce pressure loss in the liquid flow.

<Structure of Return Throttle Channel>

In each individual channel, the return throttle channel 31 is connected, at its one end (a second-side end), to the descender 29 and extends in the fourth direction d4. The descender 29 communicates the nozzle 21 with the pressure chamber 28. The fourth direction d4 has a component of a direction opposite to the third direction d3 and a component of the fifth direction d5. The fifth direction d5, which is an extending direction of the return manifold 23, is different from the third direction d3 and the fourth direction d4. Thus, the fourth direction d4 is inclined relative to the direction opposite to the third direction d3 and the fifth direction d5.

When liquid flows from the pressure chamber 28, via the descender 29, into the return throttle channel 31, the liquid flow is redirected from the third direction d3 to the stacking direction and then to the fourth direction d4. The descender 29 may reduce an influence of the flow direction in the pressure chamber 28 on the return throttle channel 31. Despite that the fourth direction d4 has a component of a direction opposite to the third direction d3, an increase in pressure loss may be suppressed.

When liquid flows from the return throttle channel 31 into the return manifold 23, the liquid flow is redirected from the fourth direction d4 to the fifth direction d5. In this case, because the fifth direction d5 has, as a directional component, a component of the fourth direction d4, liquid in the pressure chamber 28 flows in the fourth direction d4 by the use of the pressure of the liquid flow in the fifth direction d5. In addition, because the fifth direction d5 does not have, as a directional component, a component of a direction opposite to the fourth direction d4, resistance to the liquid flow in the fifth direction d5 is reduced, resulting in a reduction in pressure loss.

For example, an angle θ34 between the third direction d3 and the fourth direction d4, and an angle θ45 between the fourth direction d4 and the fifth direction d5 are greater than 0° and less than 90°. The sum of the angle θ34 and the angle θ45 is less than 180°. For example, the angle θ34 is less than the angle θ45. For example, the angle θ34 is 15° or more and 25° or less. The angle θ45 is 65° or more and 75° or less.

Further, the third communication hole 32 is located between the return throttle channel 31 and the return manifold 23. The third communication hole 32 is greater in size than the cross-sectional area defined by the return throttle channel 31 to be orthogonal to the fourth direction d4 and is less in size than the cross-sectional area defined by the return manifold 23 to be orthogonal to the fifth direction d5. Thus, the return throttle channel 31, the third communication hole 32, and the return manifold 23 gradually increase in size in this order. This may prevent a sharp increase in area and reduce pressure loss of the liquid flowing in this order.

The return throttle channel 31 has the third end 31*a* connected to the return manifold 23, and the fourth end 31*b* opposite to the third end 31*a*. The return manifold 23 includes the return opening 23*a* through which liquid returns to the exterior, and extends to receive the third ends 31*a* of the return throttle channels 31. The return throttle channel 31 extends such that, in an extending direction of the return manifold 23, the third end 31*a* is closer to the return opening 23*a* than the fourth end 31*b*.

Thus, liquid flows from the fourth end 31*b* to the third end 31*a* of the return throttle channel 31 and flows to the return opening 23*a* in the return manifold 23. In this case, a liquid flow direction (the fourth direction d4) in the return throttle channel 31 has a component of a liquid flow direction (the fifth direction d5) in the return manifold 23. This may reduce pressure loss in the liquid flow.

In an extending direction of the return throttle channel 31, a portion (e.g., the first-side end 28*b*) of the pressure chamber 28 connected to the first end 26*a* is closer to the third end 31*a* than a portion (e.g., the second-side end 28*a*) of the pressure chamber 28 connected to the fourth end 31*b*.

<First Modification>

Figure 4:
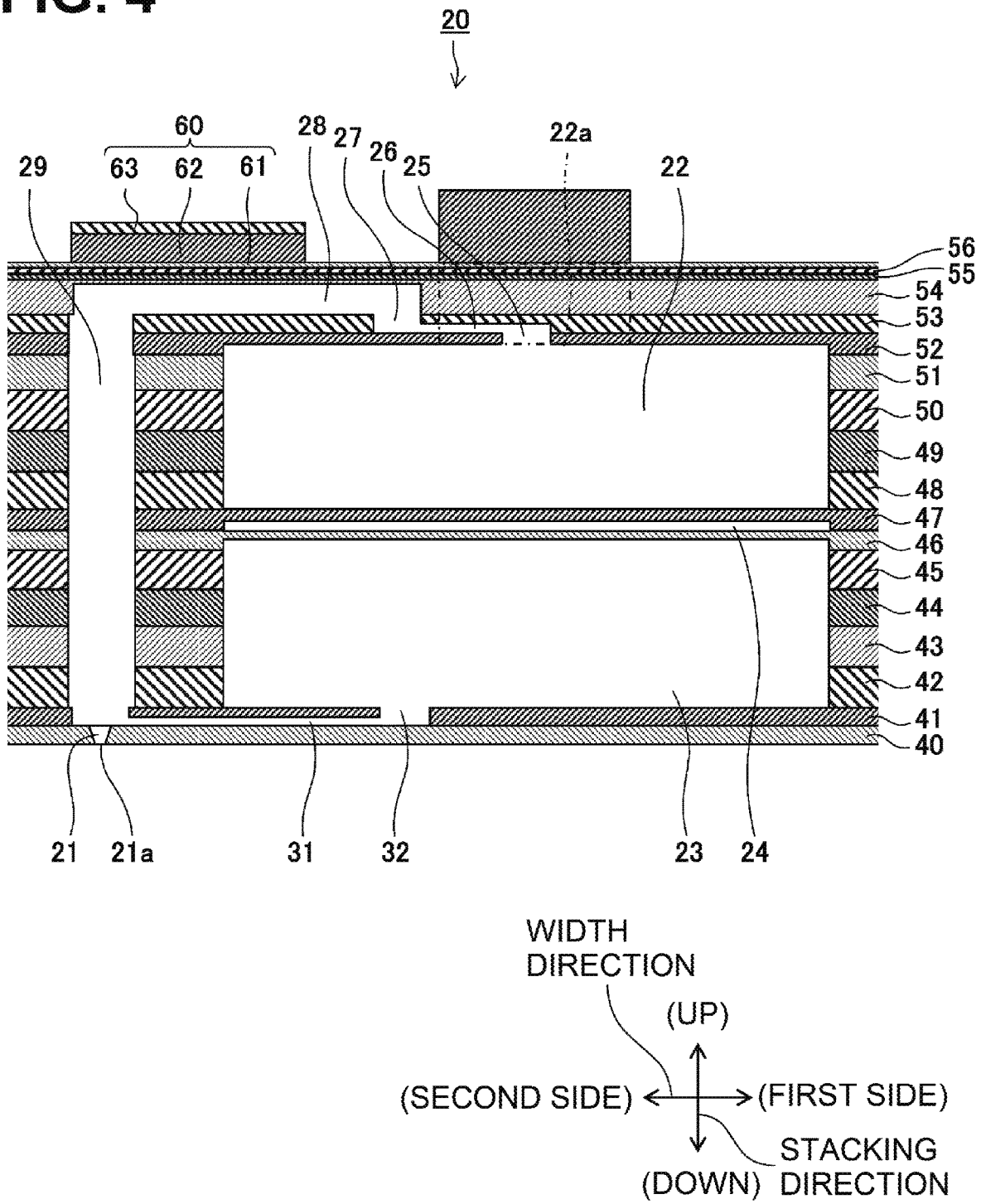
FIG. 4 is a cross-sectional view of a liquid ejection head according to a first modification of the first illustrative embodiment, taken along a line orthogonal to the array direction.

In a head 20 according to a first modification of the first illustrative embodiment, as shown in FIG. 4, one end of a supply throttle channel 26 in each individual channel is connected to a center of the supply manifold 22 in a direction orthogonal to the first direction d1. The other end of supply throttle channel 26 is connected to an upstream end of the pressure chamber 28 in the third direction d3. The elements other than the above-described elements are similar, in structure, function, and effect, to those of the first illustrative embodiment and will not be described repeatedly.

Specifically, a direction orthogonal to the first direction d1 is also orthogonal to the stacking direction and is, for example, the width direction. A first-side end (one end) of the supply throttle channel 26 is connected, via the first communication hole 25, to the center of the supply manifold 22 in the above-described orthogonal direction.

Preferably, the first communication hole 25 overlaps, in the stacking direction, the center of the supply manifold 22.

A first-side end or a second-side end of the first communication hole 25 may overlap the center of the supply manifold 22.

The flow velocity is higher at a portion closer to the center of the supply manifold 22. The supply throttle channel 26 is connected, via the first communication hole 25, to a high flow velocity portion of the supply manifold 22, thereby promoting liquid flow and reducing pressure loss.

A second-side end (the other end) of the supply throttle channel 26 is connected, via the second communication hole 27, to the upstream end of the pressure chamber 28. The second-side end of the supply throttle channel 26 is located above the supply manifold 22 in the stacking direction.

The second-side end of the supply throttle channel 26, the second communication hole 27, and the upstream end of the pressure chamber 28 overlap in the stacking direction. Thus, liquid flows from the second-side end of the supply throttle channel 26, via the second communication hole 27, into the upstream end of the pressure chamber 28 where liquid flows from the upstream end in the third direction d3. This ensures a smooth liquid flow without congestion in the pressure chamber 28.

<Second Modification>

Figure 5:
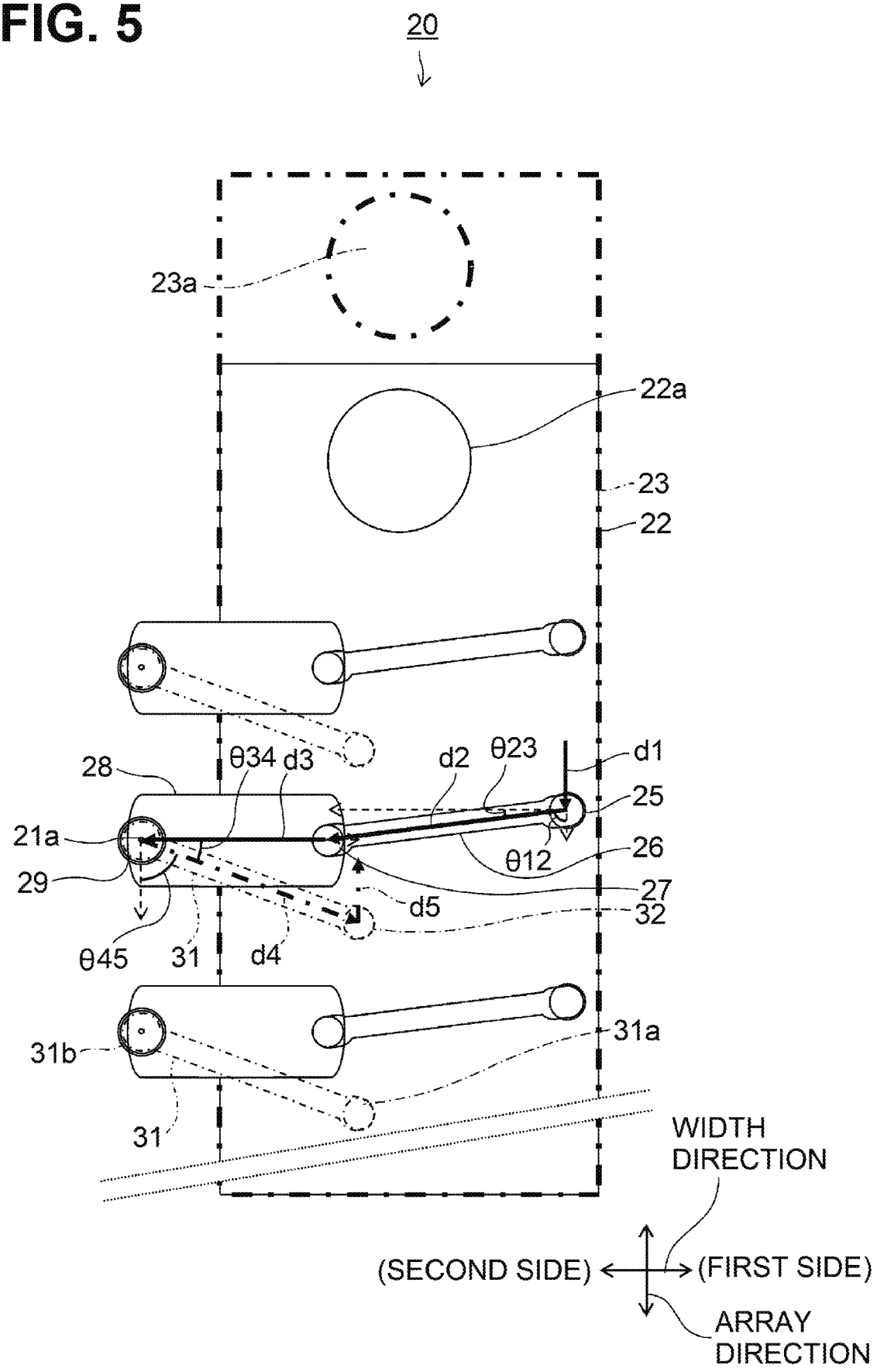
FIG. 5 is a top view of a liquid ejection head in a stacking direction, according to a second modification of the first illustrative embodiment, showing a positional relation of manifolds, throttle channels, communication holes, and pressure chambers.

In a head 20 according to a second modification of the first illustrative embodiment, as shown in FIG. 5, the descender 29 in each individual channel communicates the pressure chamber 28 with the nozzle 21, and is connected to a return throttle channel 31. A fourth direction d4 of the return throttle channel 31 has a component of a direction opposite to a third direction d3 and a component of a direction opposite to a fifth direction d5. The elements other than the above-described elements are similar, in structure, function, and effect, to those of the first illustrative embodiment and will not be described repeatedly.

In this case, the return opening 23*a* is located at one end of the return manifold 23 in the array direction. For example, the return opening 23*a* is located further to the one end in the array direction than the supply opening 22*a*.

A liquid flow direction (the fourth direction d4) in the return throttle channel 31 has a component of a direction opposite to a liquid flow direction (the fifth direction d5). Thus, a whirlpool is generated when liquid flows out from the return throttle channel 31 to the return manifold 23, thereby dispersing liquid and preventing settling of liquid components.

The return throttle channel 31 extends such that the fourth end 31*b* is closer to the return opening 23*a* than the third end 31*a* in an extending direction of the return manifold. 23. Liquid flows from the third end 31*a* to the fourth end 31*b* in the return throttle channel 31, and flows in the return manifold 23 to the return opening 23*a*. In this case, a liquid flow direction (the fourth direction d4) in the return throttle channel 31 has a component of a direction opposite to a direction of a liquid flow (the fifth direction d5). This may prevent or reduce settling of liquid components.

Second Illustrative Embodiment

Figure 6:
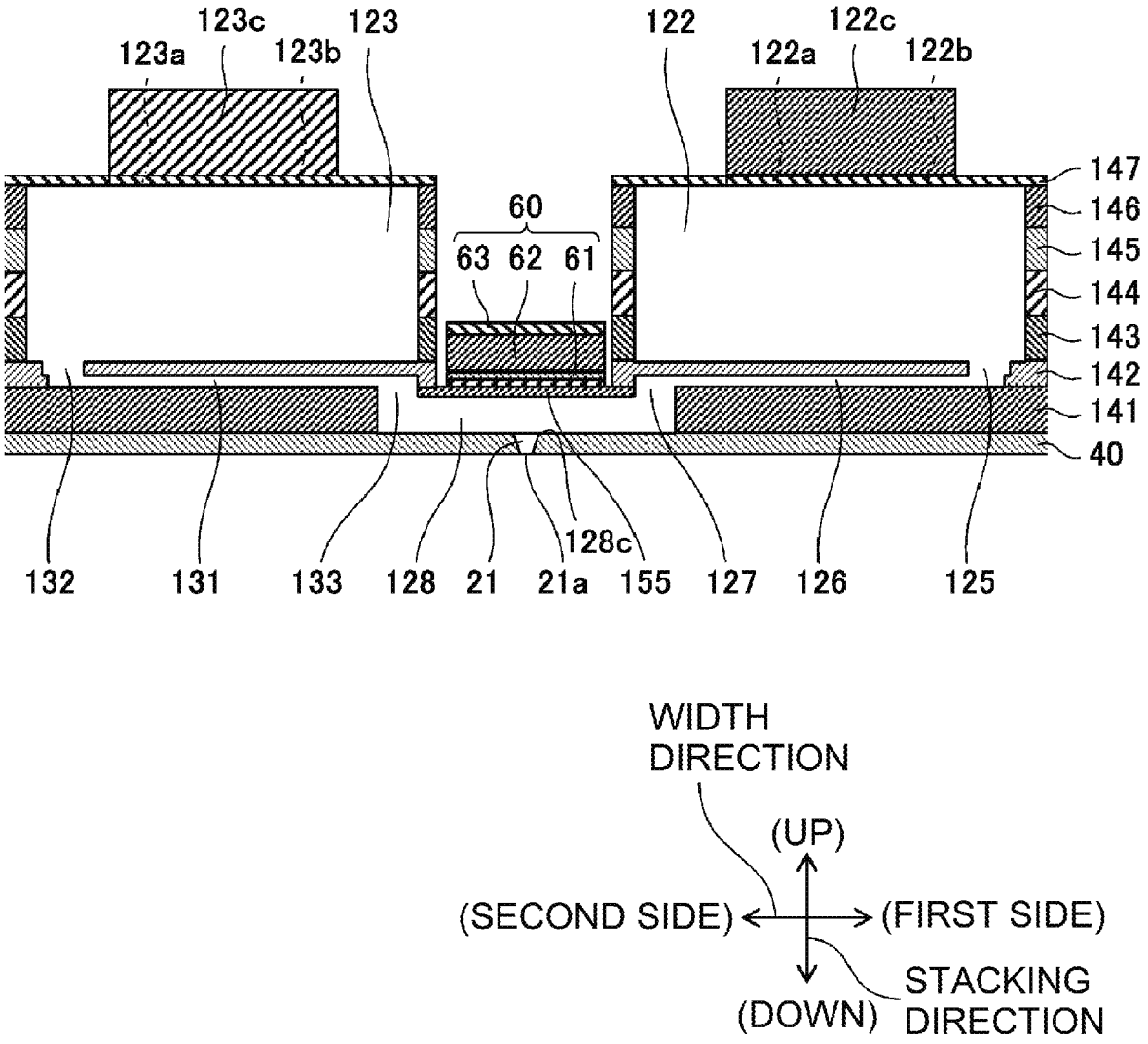
FIG. 6 is a cross-sectional view of a liquid ejection head according to a second illustrative embodiment, taken along a line orthogonal to an array direction.
Figure 7:
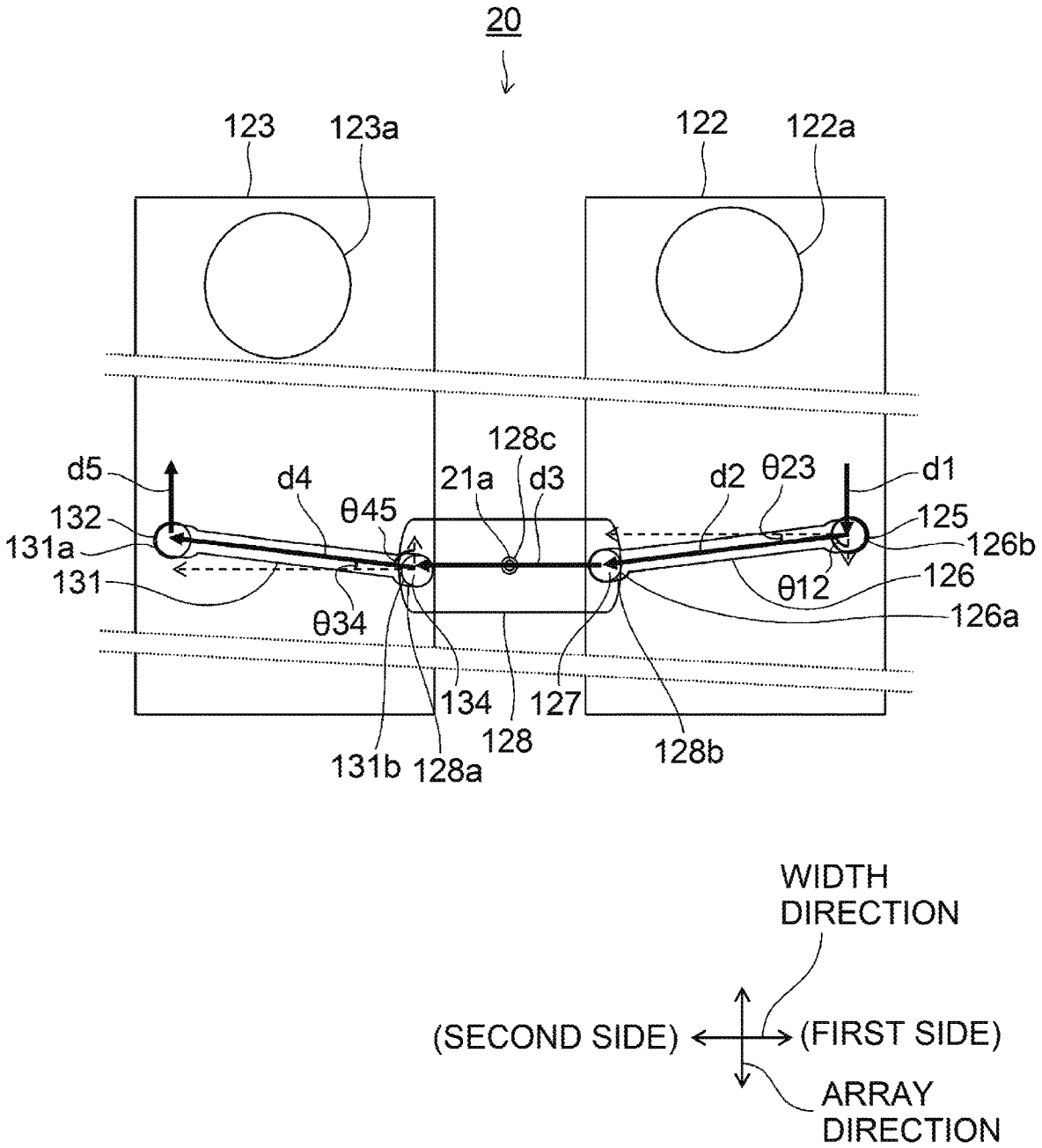
FIG. 7 is a top view of the liquid ejection head of FIG. 6 in a stacking direction, showing a positional relation of manifolds, throttle channels, communication holes, and a pressure chamber.

In a liquid ejection head 20 according to a second illustrative embodiment, as shown in FIGS. 6 and 7, a channel unit and each individual channel differ, in structure, and a supply manifold 122 and a return manifold 123 differ, in position, from those in the head 20 according to the first illustrative embodiment. The elements other than the above-described elements, are similar, in structure, function, and effect, to those of the first illustrative embodiment and will not be described repeatedly.

Specifically, the channel unit includes a nozzle plate 40, a first channel plate 141, a second channel plate 142, a third channel plate 143, a fourth channel plate 144, a fifth channel plate 145, a sixth channel plate 146, and a seventh channel plate 147. These plates are stacked in this order in a stacking direction.

The supply manifold 122 and the return manifold 123 are disposed to sandwich pressure chambers 128 therebetween in a direction orthogonal to the stacking direction (e.g., a width direction). This may downsize the liquid ejection head 20 in the stacking direction. The supply manifold 122 and the return manifold 123 may be disposed symmetrical to each other relative to a plane including axes of nozzles 21.

The supply manifold 122 and the return manifold 123 are formed to penetrate the third through sixth channel plates 143-146 in the stacking direction. The seventh channel plate 147 covers the upper ends of the supply manifold 122 and the return manifold 123.

A supply opening 122*a* is located at one end (e.g., one end in an array direction) of the supply manifold 122 in a first direction d1. A supply passage 122*b* is connected to the supply opening 122*a*, and extends upward from the supply opening 122*a* to penetrate the seventh channel plate 147. A supply port 122*c*, which has an inner space communicating with the supply passage 122*b*, is connected to the seventh channel plate 147.

A return opening 123*a* is located at one end (e.g., one end in the array direction) of the return manifold 123 in a fifth direction d5. A return passage 123*b* is connected to the return opening 123*a*, and extends upward from the supply opening 123*a* to penetrate the seventh channel plate 147. A return port 123*c*, which has an inner space communicating with the return passage 123*b*, is connected to the seventh channel plate 147. For example, the supply opening 122*a* and the return opening 123*a* are located side by side in the width direction.

Each individual channel includes a first communication hole 125, a supply throttle channel 126, a second communication hole 127, a pressure chamber 128, a fourth communication hole 133, a return throttle channel 131, and a third communication hole 132, which are arranged in this order.

The first communication hole 125 is connected, at its upper end, to a lower end of the supply manifold 122, and extends from the supply manifold 122 downward in the stacking direction to penetrate an upper portion of the second channel plate 142 in the stacking direction. The first communication hole 125 is offset to one side (a first side) from a center of the supply manifold 122 in the width direction. The cross-sectional area defined by the first communication hole 125 to be orthogonal to the stacking direction is less than the cross-sectional area defined by the supply manifold 122 to be orthogonal to the first direction d1.

The supply throttle channel 126 is connected, at its first-side end, to a downstream end of the first communication hole 125, and extends in a second direction d2. The supply throttle channel 126 is formed by a groove recessed from a lower surface of the second channel plate 142. The supply throttle channel 126 will be described in detail later.

The second communication hole 127 is connected, at its upper end, to a second-side end of the supply throttle channel 126, and extends from the supply throttle channel 126 downward in the stacking direction to penetrate an upper portion of the first channel plate 141 in the stacking direction. The second communication hole 127 is located below the supply manifold 122 and offset to the other side (a second side) from the center of the supply manifold 122 in the width direction. The cross-sectional area defined by the second communication hole 127 to be orthogonal to the stacking direction is greater than the cross-sectional area defined by the supply throttle channel 126 to be orthogonal to the second direction d2.

The pressure chamber 128 is connected, at its first-side end, to a lower end of the second communication hole 127, and extends in a third direction d3. The pressure chamber 128 is formed by a groove recessed from a lower surface of the first channel plate 141. The cross-sectional area defined by the pressure chamber 128 to be orthogonal to the third direction d3 is greater than the cross-sectional area defined by the second communication hole 127 to be orthogonal to the stacking direction. The nozzle 21 is connected to a lower end of the pressure chamber 124. For example, the nozzle 21 is located at a center of the pressure chamber 124 in a direction orthogonal to the stacking direction.

The fourth communication hole 133 is connected, at its lower end, to a second-side end of the pressure chamber 128, and extends from the pressure chamber 128 upward in the stacking direction to penetrate an upper portion of the first channel plate 141 in the stacking direction. The fourth communication hole 133 is located below the return manifold 123 and offset to one side (a first side) from the center of the return manifold 123 in the width direction. The cross-sectional area defined by the fourth communication hole 133 to be orthogonal to the stacking direction is less than the cross-sectional area defined by the pressure chamber 128 to be orthogonal to the third direction d3.

The return throttle channel 131 is connected, at its first-side end, to an upper end of the fourth communication hole 133, and extends in a fourth direction d4. The return throttle channel 131 is formed by a groove recessed from a lower surface of the second channel plate 142. The cross-sectional area defined by the return throttle channel 131 to be orthogonal to the fourth direction d4 is less than the cross-sectional area defined by the fourth communication hole 133 to be orthogonal to the stacking direction. The return throttle channel 131 and the supply throttle channel 126 extend from the pressure chamber 128 toward the same side in the array direction. The return throttle channel 131 will be described in detail later.

The third communication hole 132 is connected, at its lower end, to an upper end of the return throttle channel 131, and extends from the return throttle channel 131 upward in the stacking direction to penetrate an upper portion of the second channel plate 142 in the stacking direction. The third communication hole 132 is connected to a lower end of the return manifold 123. The third communication hole 132 is offset to a second side from the center of the return manifold 123 in the width direction. The cross-sectional area defined by the third communication hole 132 to be orthogonal to the stacking direction is greater than the cross-sectional area defined by the return throttle channel 131 to be orthogonal to the fourth direction d4.

A vibration plate 155 is formed by an upper portion of the first channel plate 141, the upper portion being above the pressure chamber 128. The vibration plate 155 may be separate from the first channel plate 41. In this case, the pressure chamber 128 penetrates the first channel plate 141 in the stacking direction, and the vibration plate 155 covers an upper side of the pressure chamber 128.

<Structure of Supply Throttle Channel>

The second direction d2 in which the supply throttle channel 126 extends has a component of the first direction d1 and a component of the third direction d3. An angle θ23 between the second direction d2 and the third direction d3 is less than an angle θ12 between the first direction d1 and the second direction d2.

The first communication hole 125 is greater in size than the cross-sectional area defined by the supply throttle channel 126 to be orthogonal to the second direction d2 and is less in size than the cross-sectional area defined by the supply manifold 122 to be orthogonal to the first direction d1. The second communication hole 127 is greater in size than the cross-sectional area of the supply throttle channel 126 in a direction orthogonal to the second direction d2 and less in size than the cross-sectional area of the pressure chamber 128 in a direction orthogonal to the third direction d3.

The supply throttle channel 126 extends such that a second end 126*b* is located closer to the supply opening 122*a* than a first end 126*a* in an extending direction of the supply manifold 122. In an extending direction of the supply throttle channel 126, the pressure chamber 128 extends such that its portion connected to the nozzle 21 is opposite to the second end 126*b* relative to its portion (a first-side end 128*b*) connected to the first end 126*a*.

<Structure of Return Throttle Channel>

The fourth direction d4 in which the return throttle channel 131 extends is inclined relative to the third direction d3 and the fifth direction d5. When liquid flows from the pressure chamber 128 into the return throttle channel 131, the liquid flow is redirected from the third direction d3 to the fourth direction d4. Because the fourth direction d4 has, as a directional component, a component of the third direction d3, liquid in the return throttle channel 131 flows in the fourth direction d4 by the use of the pressure of the liquid flow in the third direction d3. In addition, because the fourth direction d4 does not have, as a directional component, a component of a direction opposite to the third direction d3, resistance to the liquid flow in the fourth direction d4 is reduced. This may reduce pressure loss in the liquid flow.

The fourth communication hole 133 is less in size than the cross-sectional area defined by the pressure chamber 128 to be orthogonal to the third direction d3 and is greater in size than the cross-sectional area defined by the return throttle channel 131 to be orthogonal to the fourth direction d4. Thus, the pressure chamber 128, the fourth communication hole 133, and the return throttle channel 131 gradually increase in size in this order. This may prevent a sharp decrease in area and reduce pressure loss of the liquid flowing in this order.

The return throttle channel 131 has a third end 131*a* connected to the return manifold 123, and a fourth end 131*b* opposite to the third end 131*a*. The return throttle channel 131 extends such that the third end 131*a* is closer to the return opening 123*a* than the fourth end 131*b* in an extending direction of the return manifold 123. In an extending direction of the return throttle channel 131, the pressure chamber 128 extends such that its portion (e.g., a first-side end 128*b*) connected to the first end 126*a* is opposite to the third end 131*a* relative to its portion (e.g., a second-side end 128*a*) connected to the fourth end 131*b*. Thus, a liquid flow direction (the fourth direction d4) in the return throttle channel 131 has a component of a liquid flow direction (the third direction d3) in the pressure chamber 128 and a component of a liquid flow direction (the fifth direction d5) in the return manifold 123. This may reduce pressure loss in the liquid flow.

Figure 8:
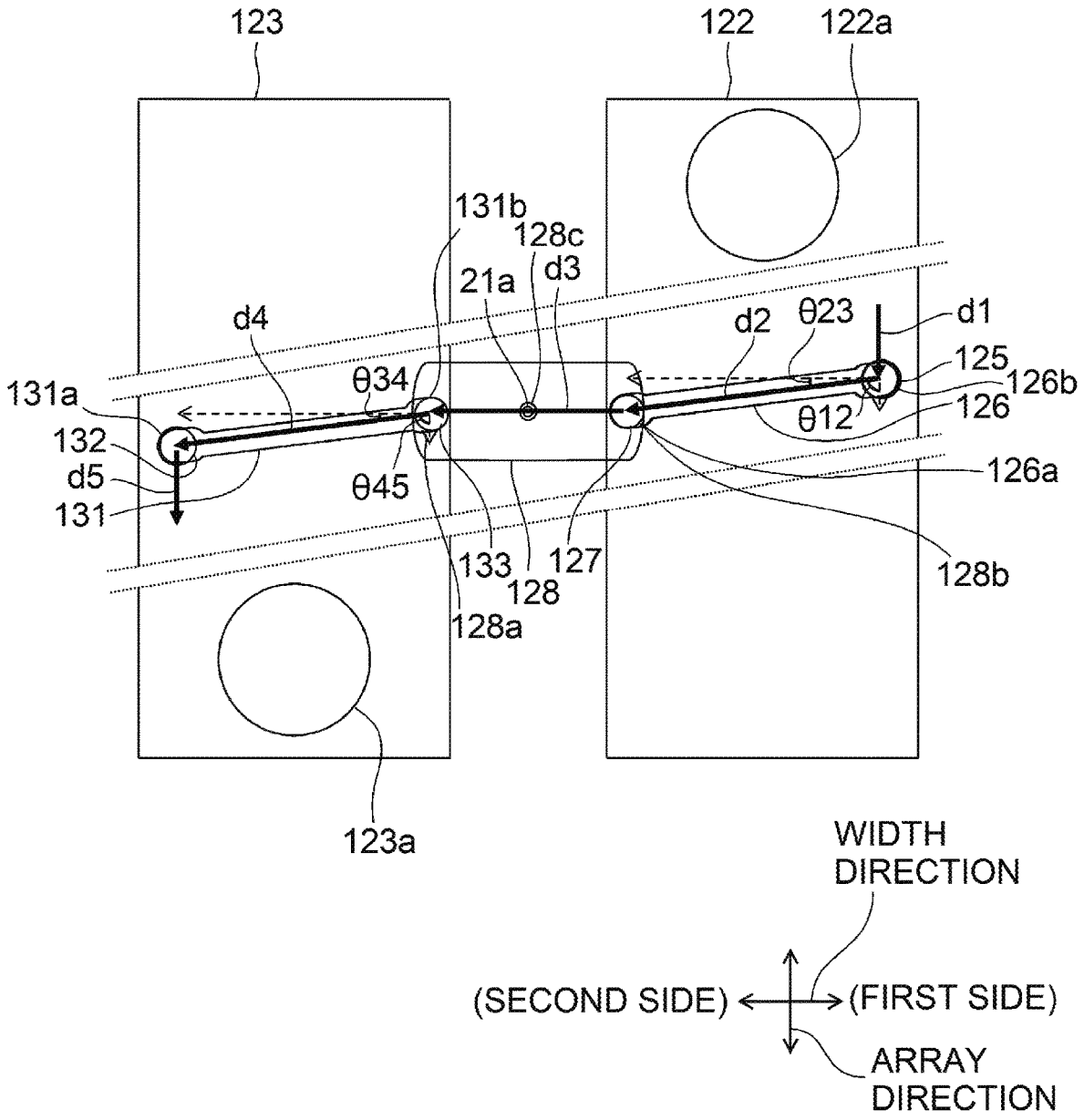
FIG. 8 is a top view of a liquid ejection head in a stacking direction, according to a modification of the second illustrative embodiment, showing a positional relation of manifolds, throttle channels, communication holes, and a pressure chamber.

In FIG. 7, the supply manifold 122 has, on its one side in the array direction, the supply opening 122*a*, and the return manifold 123 has, on its one side in the array direction, the return opening 123*a*. In contrast, as shown in FIG. 8, the supply manifold 122 may have, on its one side in the array direction, the supply opening 122*a*, and the return manifold 123 may have, on its other side in the array direction, the return opening 123*a*. In this case, the return throttle channel 131 and the supply throttle channel 126 extend from the pressure chamber 128 toward opposite sides in the array direction.

<Third Modification>

Figure 9:
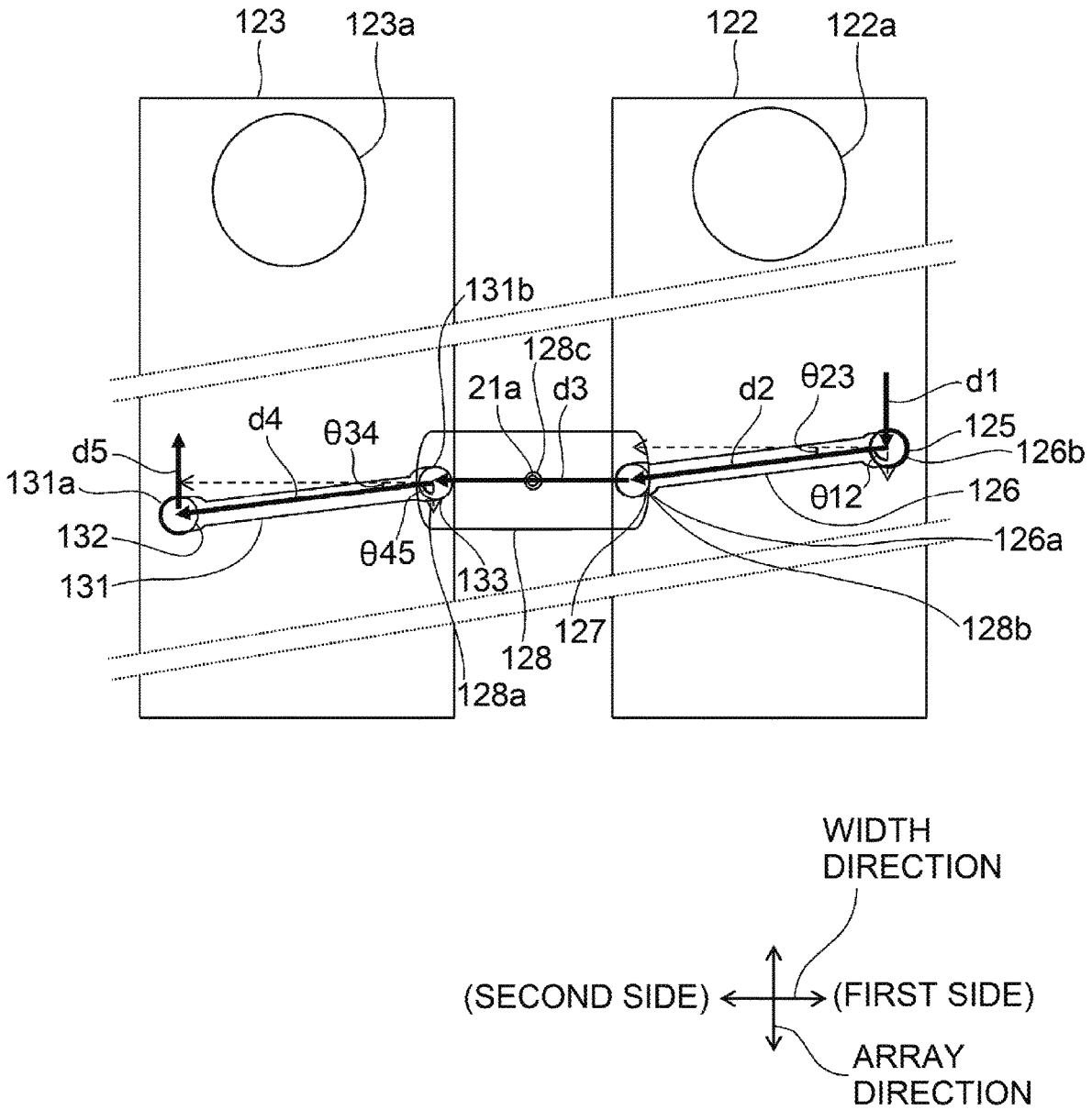
FIG. 9 is a top view of a liquid ejection head in a stacking direction, according to a third modification modified from the second illustrative embodiment, showing a positional relation of manifolds, throttle channels, communication holes, and a pressure chamber.

In a head 20 according to a third modification modified from the second illustrative embodiment, as shown in FIG. 9, a fourth direction d4 of a return throttle channel 131 has a component of a direction opposite to the fifth direction d5 and a component of the third direction d3. The elements other than the above-described element are similar, in structure, function, and effect, to those of the second illustrative embodiment and will not be described repeatedly.

A liquid flow direction (the fourth direction d4) in the return throttle channel 131 has a component of a direction opposite to a liquid flow direction (the fifth direction d5) in the return manifold 123. Thus, a whirlpool is generated when liquid flows out from the return throttle channel 131 to the return manifold 123, thereby dispersing liquid and preventing settling of liquid components.

In this case, the return throttle channel 131 extends such that, in an extending direction of the return manifold 123, a fourth end 131*b* is closer to the return opening 123*a* than a third end 131*a*. In an extending direction of the return throttle channel 131, the pressure chamber 128 extends such that its portion (e.g., a first-side end 128*b*) connected to the first end 126*a* is opposite to the third end 131*a* relative to its portion (e.g., a second-side end 128*a*) connected to the fourth end 131*b*. Thus, a liquid flow direction (the fourth direction d4) in the return throttle channel 131 has a component of a liquid flow direction (the third direction d3) in the pressure chamber 128 and a component of a direction opposite to a liquid flow direction (the fifth direction d5) in the return manifold 123. This may prevent or reduce settling of liquid components.

While the disclosure has been described with reference to the specific embodiments thereof, these are merely examples, and various changes, arrangements and modifications may be applied therein without departing from the spirit and scope of the disclosure.

What is claimed is:

1. A liquid ejection head comprising:

a supply manifold including a supply opening through which liquid is supplied from an exterior, the supply manifold extending in a first direction;

a plurality of supply throttle channels each connected, at one end thereof, to the supply manifold, and each extending in a second direction;

a plurality of pressure chambers each connected to the other end of a corresponding one of the supply throttle channels, and each extending in a third direction different from the first direction;

a plurality of nozzles each communicating with a corresponding one of the pressure chambers;

a plurality of return throttle channels each connected, at one end thereof, to a corresponding one of the pressure chambers and extending in a fourth direction; and a return manifold connected to the other end of each of the return throttle channels and including a return opening through which liquid is discharged to the exterior, the return manifold extending in a fifth direction different from the fourth direction, wherein the second direction in which each of the supply throttle channels extends has a component of the first direction and a component of the third direction, and wherein the fourth direction in which each of the return throttle channels extends has a component of the third direction and a component of the fifth direction.

2. The liquid ejection head according to claim 1, wherein an angle between the second direction and the third direction is less than an angle between the second direction and the first direction.

3. The liquid ejection head according to claim 1, wherein the one end of each of the supply throttle channels is connected to a center of the supply manifold in a direction orthogonal to the first direction, and wherein the other end of each of the supply throttle channels is connected to one end of a corresponding one of the pressure chambers.

4. The liquid ejection head according to claim 1, further comprising a plurality of communications holes each positioned between a corresponding one of the pressure chambers and a corresponding one of the supply throttle channels.

5. The liquid ejection head according to claim 4, wherein each of the communication holes is greater in size than a cross-sectional area defined by each of the supply throttle channels to be orthogonal to the second direction, and is less in size than a cross-sectional area defined by each of the pressure chambers to be orthogonal to the third direction.

6. The liquid ejection head according to claim 1, wherein the supply manifold and the return manifold overlap each other in a direction orthogonal to a plane including the third direction and the first direction.

7. The liquid ejection head according to claim 1, wherein the fourth direction in which each of the return throttle channels extends has a component of the third direction and a component of a direction opposite to the fifth direction.

8. The liquid ejection head according to claim 1, further comprising a plurality of descenders each communicating a corresponding one of the nozzles with a corresponding one of the pressure chambers, and each descender being connected to a corresponding one of the return throttle channels, wherein the fourth direction in which each of the return throttle channels extends has a component of a direction opposite to the third direction and a component of the fifth direction.

9. The liquid ejection head according to claim 1, further comprising a plurality of descenders each communicating a corresponding one of the nozzles with a corresponding one of the pressure chambers, each descender being connected to a corresponding one of the return throttle channels, wherein the fourth direction in which each of the return throttle channels extends has a component of a direction opposite to the third direction and a component of a direction opposite to the fifth direction.

10. The liquid ejection head according to claim 1, wherein liquid flowing in each of the return throttle channels has a resistance of 0.7 kPa·s/μl·cps or more.

11. A liquid ejection head comprising:

a nozzle;

a pressure chamber connected to the nozzle;

a supply throttle channel having a first end connected to the pressure chamber, and a second end opposite to the first end; and a supply manifold including a supply opening through which liquid is supplied from an exterior, the supply manifold being connected to the second end of the supply throttle channel;

wherein the supply throttle channel extends such that, in an extending direction of the supply manifold, the second end thereof is closer to the supply opening than the first end thereof, and wherein the pressure chamber extends such that, in an extending direction of the supply throttle channel, a portion of the pressure chamber connected to the nozzle is opposite to the second end of the supply throttle channel relative to a portion of the pressure chamber connected to the first end of the supply throttle channel, the portion of the pressure chamber connected to the nozzle being disposed proximate to a first end of the pressure chamber in a pressure chamber extending direction, and the portion of the pressure chamber connected to the first end of the supply throttle channel being disposed proximate to a second end of the pressure chamber opposite to the first end of the pressure chamber in the pressure chamber extending direction.

12. The liquid ejection head according to claim 11, further comprising:

a return manifold including a return opening through which liquid is discharged to the exterior; and a return throttle channel having a third end connected to the return manifold, and a fourth end opposite to the third end, wherein the return throttle channel extends such that, in an extending direction of the return manifold, the third end thereof is closer to the return opening than the fourth end thereof, and wherein the pressure chamber extends such that, in an extending direction of the return throttle channel, the portion thereof connected to the first end of the supply throttle channel is opposite to the third end of the return throttle channel relative to a portion thereof connected to the fourth end of the return throttle channel.

13. The liquid ejection head according to claim 11, further comprising:

a return manifold including a return opening through which liquid is discharged to the exterior; and a return throttle channel having a third end connected to the return manifold, and a fourth end opposite to the third end, wherein the return throttle channel extends such that, in an extending direction of the return manifold, the fourth end thereof is closer to the return opening than the third end thereof, and wherein the pressure chamber extends such that, in an extending direction of the return throttle channel, the portion thereof connected to the first end of the supply throttle channel is opposite to the third end of the return throttle channel relative to the portion thereof connected to the fourth end of the return throttle channel.

14. The liquid ejection head according to claim 11, further comprising:

a return manifold including a return opening through which liquid is discharged to the exterior;

a return throttle channel having a third end connected to the return manifold, and a fourth end opposite to the third end; and a descender communicating the nozzle with the pressure chamber, and connected to the return throttle channel, wherein the return throttle channel extends such that, in an extending direction of the return manifold, the third end thereof is closer to the return opening than the fourth end thereof, and wherein the pressure chamber extends such that, in an extending direction of the return throttle channel, the portion thereof connected to the first end of the supply throttle channel is closer to the third end of the return throttle channel than the portion thereof connected to the fourth end of the return throttle channel.

15. The liquid ejection head according to claim 11, further comprising:

a return manifold including a return opening through which liquid is discharged to the exterior;

a return throttle channel having a third end connected to the return manifold, and a fourth end opposite to the third end; and a descender communicating the nozzle with the pressure chamber, and connected to the return throttle channel, wherein the return throttle channel extends such that, in an extending direction of the return manifold, the fourth end thereof is closer to the return opening than the third end thereof, and wherein the pressure chamber extends such that, in an extending direction of the return throttle channel, the portion thereof connected to the first end of the supply throttle channel is closer to the third end of the return throttle channel than the portion thereof connected to the fourth end of the return throttle channel.

* * * * *